US006823874B2

(12) United States Patent
Lexcen

(10) Patent No.: US 6,823,874 B2
(45) Date of Patent: Nov. 30, 2004

(54) HAIR CURLING COMB DEVICE

(76) Inventor: Frances Josephine Lexcen, 985 Paulsboro Dr., Rockville, MD (US) 20850

( * ) Notice: Subject to any disclaimer, the term of this patent is extended or adjusted under 35 U.S.C. 154(b) by 81 days.

(21) Appl. No.: 10/150,728

(22) Filed: May 17, 2002

(65) Prior Publication Data

US 2003/0213497 A1 Nov. 20, 2003

(51) Int. Cl.[7] ..... A45D 24/04
(52) U.S. Cl. ..... 132/126; 132/144; 132/160
(58) Field of Search ..... 132/122, 139, 132/140, 142, 137, 226, 268, 152, 223, 141, 150, 160, 124, 232, 144, 126, 138, 148, 158

(56) References Cited

U.S. PATENT DOCUMENTS 379,650 A * 3/1888 Levy ..... 132/122
1,359,343 A * 11/1920 Dodge ..... 132/124
1,675,754 A * 7/1928 Grom ..... 132/139
1,824,665 A * 9/1931 Ehrlich ..... 132/149
2,288,156 A * 6/1942 Dove ..... 132/124
2,348,339 A * 5/1944 Golden ..... 132/142
2,479,631 A * 8/1949 Liebert ..... 132/136
2,633,591 A * 4/1953 Servilla ..... 15/160
3,192,934 A * 7/1965 Catania ..... 132/136
3,205,903 A * 9/1965 D'Avanzo ..... 132/139
3,402,730 A * 9/1968 Lawrence ..... 132/139
3,750,680 A * 8/1973 Miller ..... 132/119.1
3,935,423 A * 1/1976 Pucci ..... 219/225
4,250,902 A * 2/1981 Ihara ..... 132/271
5,152,306 A * 10/1992 Stephan ..... 132/139

* cited by examiner

*Primary Examiner*—Kevin Shaver
*Assistant Examiner*—Stephanie Willatt
(74) *Attorney, Agent, or Firm*—Edgar S. Burr

(57) ABSTRACT

The present invention is a comb that includes curved or angular teeth placed perpendicular to a cylindrical handle in a straight or helical path. It can be drawn through a lock of hair to create a ringlet curl that hangs free from the scalp. It may optionally include a second row of teeth, or an individual tooth, that incorporates additional strands of hair into the curl. The comb may include an extension that smoothes hair over the teeth. In operation one uses the comb to dress wet or dry hair. The first row of curved teeth is applied to the hair at the root, and drawn through the hair with a rotating motion that is consistent with the direction of the curve of the comb's teeth resulting in a ringlet curl that hangs free from the head.

2 Claims, 5 Drawing Sheets

HAIR CURLING COMB DEVICE

CROSS REFERENCE TO RELATED APPLICATIONS

Not applicable

STATEMENT REGARDING FEDERALLY SPONSORED RESEARCH OR DEVELOPMENT

Not applicable

INCORPORATION-BY-REFERENCE OF MATERIAL SUBMITTED ON A COMPACT DISC

Not applicable

BACKGROUND OF THE INVENTION

This invention relates to hair dressing, specifically, to combs which are used for dressing curly hair to form ringlets which hang free of the scalp. Hair must be combed to be properly groomed. However, traditional, straight-toothed combs pull hair into a straight line that removes curl and separates curly or curled hair into such small segments of strands that natural or natural-looking curls are destroyed. This invention combs hair into curls by use of curved or angular teeth that are set perpendicularly to a handle. Additional optional features include auxiliary teeth for adding strands to the original lock being combed if the user so desires, and an optional extension of a smoothing pin that is attached parallel to the handle and smoothes hair across the curved teeth.

The prior art in this field includes combs with straight teeth that are used to groom hair. Some of these include a single curved tooth for separating segments of hair in preparation for other dressing activities. Some include a pin, finger or other extension for smoothing hair over the straight teeth for distributing coloring agents evenly. These combs are not for curling hair, and effectively straighten hair by pulling curls straight. There are combs for securing hair to the head in a bun or twist that have curved teeth for securing locks to the scalp, but not for curling or combing hair. There are hair twisting devices that implement straight-toothed combs or clamping devices to wrap strands of hair around one another, preventing locks of hair from hanging free of the scalp and of one another. These are typically motorized, or include a heating element. Examples of combs using straight teeth can be found in U.S. Pat. Nos. 2,333,326; 3,386,453; 3,529,609; 4,026,307; 5,091,630 and 5,240,017. Examples of combs using a single curved tooth can be found in U.S. Pat. Nos. 2,616,435 and 3,042,048. Examples of combs using a finger, pin or smoothing extension can be found in U.S. Pat. Nos. 2,005,187; 2,288,156; 3,368,569; 4,108,186 and 5,765,572. Examples of combs for securing hair to the head can be found in U.S. Pat. Nos. 2,299,770; 2,446,781; 3,292,641; 4,522,215; 5,249,589 and 5,273,058. Examples of combs for twisting, teasing and rotating can be found in U.S. Pat. Nos. 3,750,680; 3,863,652; 3,892,246; 4,824,036; 5,119,847; 5,191,907; 5,671,759; 5,725,000; 6,109,275 and 5,488,963.

BRIEF SUMMARY OF THE INVENTION

The present invention is a comb that can be produced inexpensively of any sturdy, flexible material such as rubber or plastic, or any other materials conventionally used in combs or hairdressing devices. As such, it does not require a motorized device in order to be used and can be used by almost anyone in a manual application.

It has curved or angular teeth placed perpendicular to a handle that can be drawn through a lock of hair to create a ringlet curl that hangs free from the scalp. It does not twist the hair or require that the hair be secured to the scalp after grooming. It may optionally include a second row of teeth, or individual teeth placed in a helical path around the handle, that incorporate additional strands of hair into the curl as the user desires. It may optionally include an extension that smoothes the hair over the curved teeth. It does not require a motor or a heating element, although it could be adapted for use with either or both of these as an accessory to a hand-held hairdryer or curling iron.

BREIF DESCRIPTION OF THE SEVERAL VIEWS OF THE DRAWINGS

DETAILED DESCRIPTION OF THE INVENTION

Figure 1:
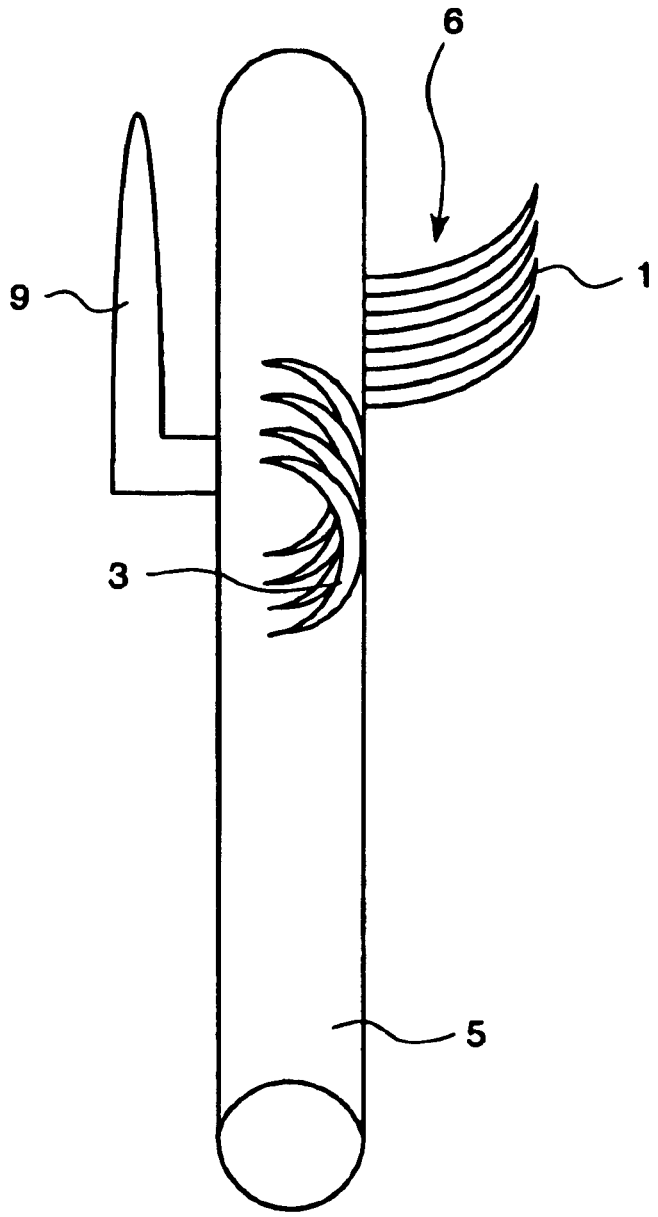
FIGS. 1 and 2 show different aspects of a comb with two rows of curved teeth and an extension that smoothes hair across the curved teeth.
Figure 2:
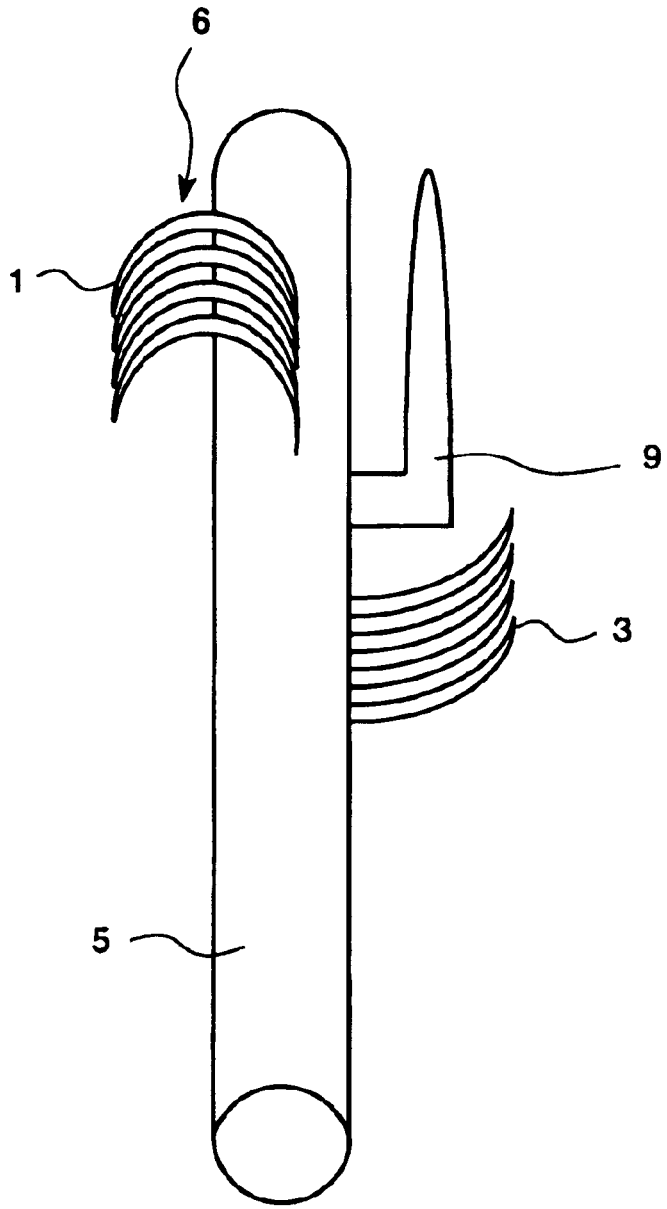

A preferred embodiment of the present comb is illustrated in FIGS. 1 and 2. The comb has a cylindrical handle (5) that extends above and below the rows of curved teeth (1) and (3). Row (1) begins the ringlet and row (3) incorporates additional locks of hair into the ringlet. A smoothing pin (9) aids in drawing hair across the curved teeth (1) and (3). As clearly shown in FIG. 2, when the two sets of teeth (1) and (3) are provided the smoothing pin (9) is attached to cylindrical handle (5) between the two sets of teeth (1) and (3). In the preferred embodiment, the handle, teeth and pin are made of any material suitable for making combs. In an alternative embodiment, these elements could be made from materials suitable for an accessory for a hand-held hair dryer or curling iron.

Figure 3:
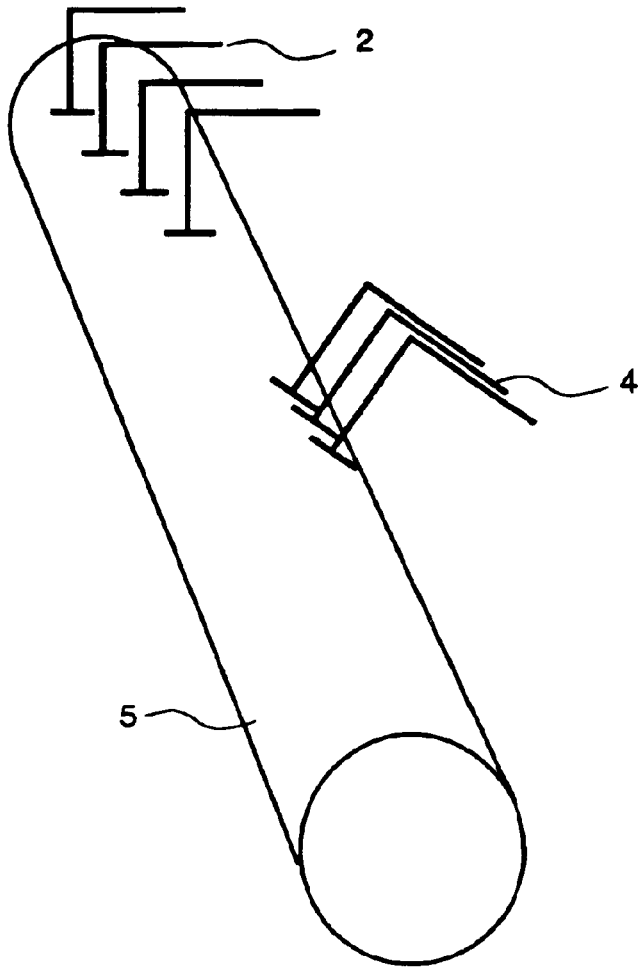
FIG. 3 shows a similar comb with angular teeth with a single bend.
Figure 4A:
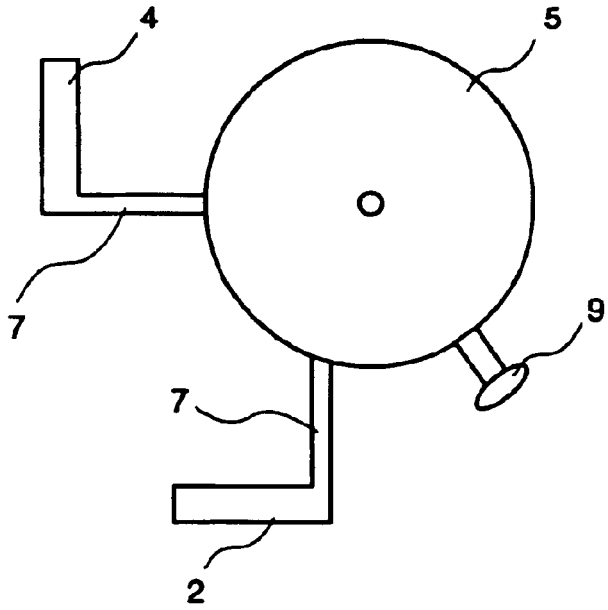
FIGS. 4A and 4B show top views of the handle with angular and curved teeth and a top view of the smoothing pin.
Figure 4B:
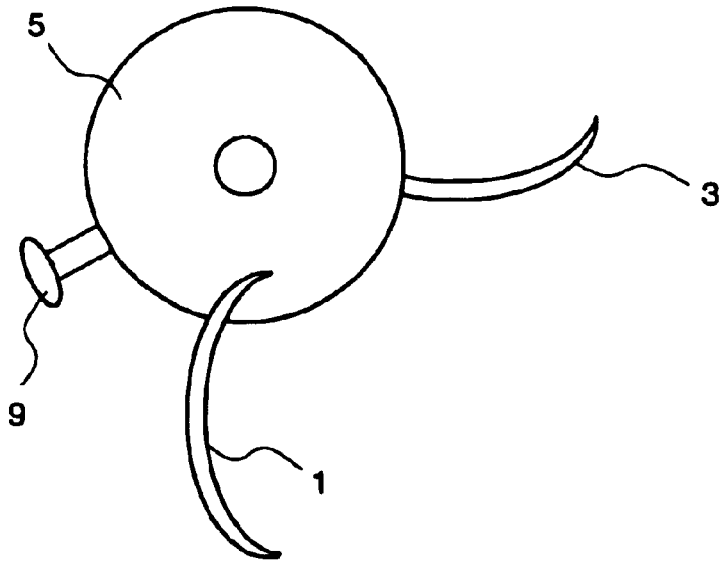

An additional embodiment of the present comb is illustrated in FIGS. 3 and 4A, where the teeth of the comb are formed with a single angular bend so that each tooth has a first portion (7) which extends away from the handle and supports a second portion (2) or (4) of the tooth which is substantially perpendicular to the first portion (7). Teeth could have more than a single bend. FIG. 4B shows a top view of a comb with curved teeth (1) and (3).

Figure 5:
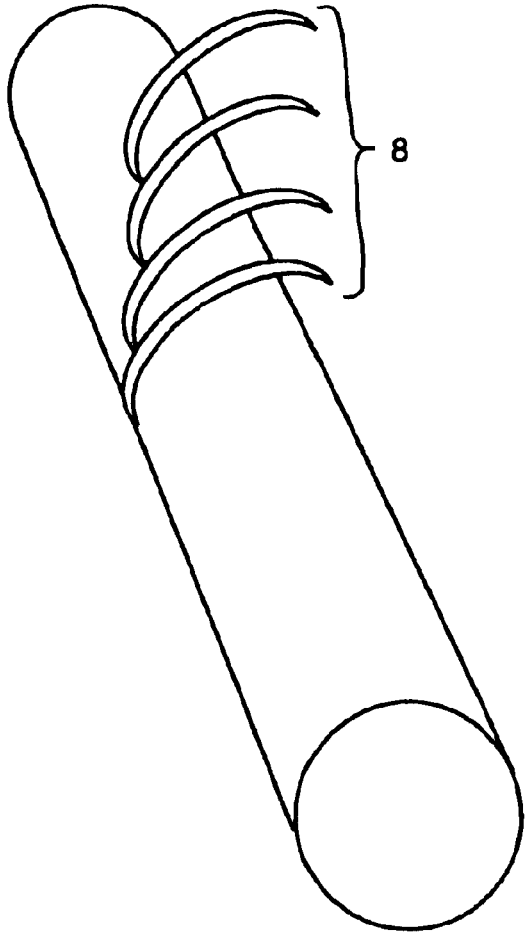
FIG. 5 shows a comb with teeth placed in a helical path.

An alternative embodiment of the present comb is illustrated in FIG. 5, where the teeth are set in a helical path (8) around the cylindrical handle.

In operation one uses the comb to dress wet or dry hair. The manner of using the comb is to place the upper row of curved teeth against the scalp and to draw it through the hair in a rotating fashion (e.g. clockwise) consistent with the direction of the teeth. As the comb is drawn from the roots of the hair to the ends of the hair, the second row of teeth can be used to incorporate additional locks of hair into the ringlet being formed. In effect, the curved teeth serve to remove tangles and groom the hair while forming a ringlet around the cylindrical handle. The smoothing pin (9) coaxes the hair across the rows of teeth as it draws the hair close to the handle. As the comb reaches the ends of the hair, the cylinder above the upper row of teeth is drawn out of the hair, leaving the hair hanging free from the scalp in a formed ringlet.

A number of advantages are evident in this design. The teeth of this comb are curved and do not pull hair straight. There are multiple teeth in each row, so it does not merely separate a section of hair from the scalp as do combs with a single curved tooth. The smoothing pin coaxes hair across curved teeth to aid in forming a ringlet without clamping or straightening the hair. The comb allows the hair to hang free from the scalp in a natural style, and does not secure the hair to the scalp or to other pieces of hair. The comb draws the hair away from the scalp and around the cylindrical handle to avoid teasing and tangling, and does not twist one piece of hair around another.

The comb can be adapted to a number of desirable uses. For example, the diameter and length of the handle can be adapted to change the size of the curl. The teeth of the comb can be spaced at varying widths to accommodate larger sections of hair. The curve or angle of the teeth can be varied to change the size of the curl. The length of the teeth can be short or long by user preference. The rows of the teeth can be single, double, or multiple. The rows of teeth can be spaced around the diameter of the cylindrical handle at a variety of angles to one another, including in helical path design.

Further adaptations include: setting the teeth into a rotating head that is produced separately and attached to the handle in a manner that allows it to rotate independently of the handle; producing the handle and rows of teeth separately and attaching them to one another in a manner that allows the teeth to be moved from one end of the handle to the other end of the handle, or to be permanently attached, as desired. Finally, the comb can also be made of materials suitable for use with a heating element so it can be attached to a hand-held hair dryer or curling iron.

The reader will see that this comb provides an economical, manual means of grooming hair that creates and enhances curliness in the hair by drawing the hair through curved teeth in a rotating manner. Unlike conventional combs, it does not straighten hair in the process of grooming. It can be adapted to a variety of curved or bent teeth positioned in several positions around the handle. The handle itself can be made to varying widths to accommodate desired curl sizes for different hair styles. The comb can be made in a variety of materials that are conventionally used to make combs, and can be adapted to materials that are suitable for an accessory to a hand-held hair dryer or curling iron.

While my description contains many specificities, these should not be construed as limitations on the scope of the invention but rather as an exemplification of one preferred embodiment thereof. Many other variations are possible. Accordingly, the scope of the invention should be determined not by the embodiment(s) illustrated, but by the appended claims and their legal equivalents.

SEQUENCE LISTING

Not applicable

What is claimed is:

1. A comb for removing tangles from and dressing curly hair and forming it into ringlets which hang free from the scalp comprising a substantially cylindrical handle which extends the entire length of the comb, said handle having a first portion to be grasped by a user and a second portion having two rows of curved teeth, said two rows of curved teeth being axially and circumferentially spaced from one another along said second portion, and a smoothing pin, said smoothing pin being rigidly attached to said second portion of said handle so as to be fixed with respect to said handle and extending in a direction substantially parallel to said handle and away from said first portion of said handle, said rigid attachment being at a point axially between said two rows of teeth, said second portion of said handle extending a distance past said teeth whereby when the teeth are placed against a scalp and drawn through the hair from the roots to the ends of the hair while said handle is rotated they serve to remove the tangles and form a ringlet of hair around the cylindrical handle second portion without clamping or straightening the hair.

2. The comb of claim 1 wherein each of said two rows are arranged in a straight line.

* * * * *